US005478076A

United States Patent [19]

Desjardins

[11] Patent Number: 5,478,076

[45] Date of Patent: Dec. 26, 1995

[54] GOLF PUTTING AMUSEMENT SYSTEM

[76] Inventor: Pierre Desjardins, 919 Châteauneuf Street, Bellefeuille, Quebec, Canada, J0R 1A0

[21] Appl. No.: 185,132

[22] Filed: Jan. 24, 1994

[51] Int. Cl.[6] ..... A63B 57/00

[52] U.S. Cl. ..... 273/176 R; 273/34 R; 273/183.1; 273/33; 273/177 R

[58] Field of Search ..... 273/32 R, 176 R, 273/176 A, 176 B, 176 D, 176 FA, 34 R, 177 R, 178 R, 179 R, 180, 177 A, 34 A, 33, 181 R, 182 R, 181 C, 181 H, 183.1, 184 R, 87 R, 371, 374, 375, 376, 381; 472/51, 52, 53, 56

[56] References Cited

U.S. PATENT DOCUMENTS

D. 84,224 5/1931 Valvano ..... 273/176 D 3,645,536 2/1972 Tierney ..... 273/176 FA 4,120,496 10/1978 Nijna ..... 273/34 R

*Primary Examiner*—William M. Pierce

[57] ABSTRACT

A golf putting amusement system which comprises a plurality of putting platforms each having a putting deck with a golf ball area at one end and which may have a golf ball support tee extending above the top surface of the deck. A golf cup area is provided at an opposed end of the deck. Grass simulation means is provided on the top surface of the putting deck. A golf cup having an open top end is removably secured under the putting area at the golf cup area, with the top end being opened in the top surface. The cup is fabricated such as to induce laughter to a player person when a golf ball touches, enters, or is retrieved from the cup. The tees also provide laughter inducement. The platforms are prefabricated platforms and disposed in a specific orientation with respect to one another. The platforms may be interchanged at the playing site or with other playing sites.

16 Claims, 5 Drawing Sheets

GOLF PUTTING AMUSEMENT SYSTEM

TECHNICAL FIELD

The present invention relates to a golf putting amusement system comprised of putting platforms with cups having means to induce laughter to the player and wherein when a golf ball touches, enters, or is retrieved from the cup it induces laughter to a player person. The tees may also be provided with means to induce laughter.

BACKGROUND ART

Miniature golf putting amusement systems are known, and they consist essentially of delineated putting surfaces, most being fabricated from concrete slabs, and there are usually eighteen of these, oriented in a specific manner. A tee area is provided at one end where a golf ball is struck with a putter and aimed at a cup positioned at the other end. A grass-simulated carpet is usually secured over the concrete putting surfaces. The golf ball is placed at any position at the teeing area, and struck so as to be directed towards the cup, and there are usually obstacles provided intermediate the teeing area and the cup to test the skill of the person striking the golf ball. In this amusement game the person usually counts the strokes required on each putting surface to direct the ball from the teeing area to the cup. The only amusement provided to the user is usually the test of skill around obstacles positioned in the path between the putting area and the cup. It is more a competitive game that can sometimes be very serious, the intent not being to create laughter.

SUMMARY OF THE INVENTION

It is a feature of the present invention to provide a golf putting amusement system which is different from known prior art systems wherein the tees and the cup are provided with laughter-inducing means to induce laughter to a player person when a golf ball touches, enters, or is retrieved from the cup, or when a golf ball is placed on a golf ball tee.

Another feature of the present invention is to provide a golf putting amusement system comprising a plurality of putting platforms each having a teeing area and a cup area and wherein the tees and/or cups are provided with means to induce laughter to a person playing the game or to other people presently using the amusement system.

Another feature of the present invention is to provide a golf putting amusement system comprising a plurality of putting platforms having tees and cups with laughter-inducing means of different types, and wherein the putting platforms may be oriented or interchanged with other playing sites to delineate amusement systems of different layouts.

Another feature of the present invention is to provide a golf putting amusement system comprising a plurality of putting platforms having tees and cups with means to induce laughter, wherein one of the cups is secured to an external activatable means to activate a water sprinkling system or a sound and light system to induce laughter to other people presently utilizing the golf putting amusement system.

According to the above features, from a broad aspect, the present invention provides a golf putting amusement system comprising a plurality of putting platforms each having a putting deck with a golf ball teeing area at one end having a golf ball support tee extending above the top surface of the deck. A golf cup area is provided at an opposed end of the deck. Grass-simulating means is provided on at least a portion of a top surface of the putting deck. A golf cup having an open top end is removably secured under the putting area at the golf cup area with the top end being opened in the top surface. The cup has laughter-inducing means to induce laughter to a player person when a golf ball touches, enters, or is retrieved from the cup. The platforms are prefabricated platforms disposed in a specific orientation with respect to one another.

BRIEF DESCRIPTION OF DRAWINGS

A preferred embodiment of the present invention will now be described with reference to the accompanying drawings in which.

BRIEF DESCRIPTION OF PREFERRED EMBODIMENTS

Figure 1:
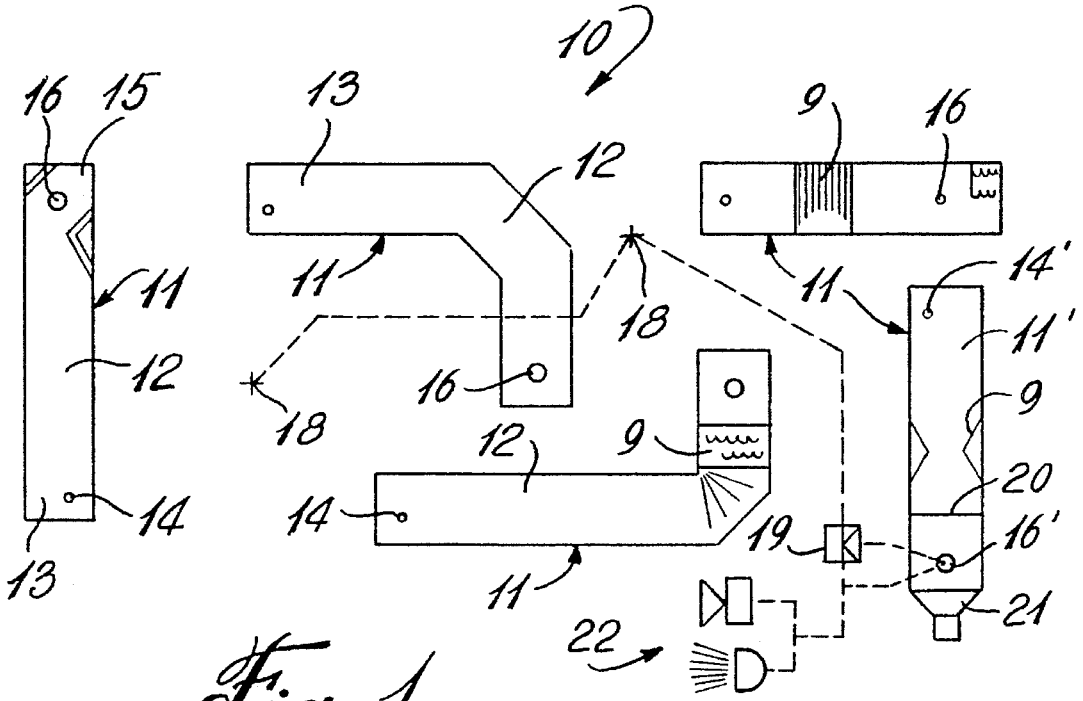
FIG. 1 is a plan view showing a golf putting amusement system of the present invention illustrating a few of the plurality of putting platforms associated therewith as well as external activatable means associated with the amusement system.

Referring to the drawings, and more particularly to FIG. 1, there is shown generally at 10 the golf putting amusement system of the present invention. It comprises a plurality of putting platforms 11 which are generally of elongated rectangular form but may be angulated at different angles, and each having a putting deck 12. The putting decks have a golf ball teeing area 13 at one end with a golf ball support tee 14 located at a predetermined area thereon. It is pointed out that this golf tee is optional with some of the platforms and the ball may be placed at different locations in the teeing area 13 which may be a flat, unobstructed surface.

The other end of the platforms 11 define a golf cup area 15. A golf cup 16 is secured at a predetermined location at the golf cup area 15. A plurality of these putting platforms 11 are oriented in a specific manner and they are usually eighteen of these disposed within a golf putting amusement system. As herein shown, one of the cups, herein cup 16' usually of the eighteenth platform 11', is provided with a switch, as will be described later, to detect a ball entering the cup 16'. This switch is connected to a sprinkler system having a water pressure conduit 17 connected to one or more sprinklers 18. The switch controls to a valve 19 which turns on the sprinklers 18 when the ball enters the cup 16'. The platform 11' is also provided with a cage 20 in the area of the cup 16' with a ball retrieving funnel 21, or other such means, whereby when a ball is struck from the tee 14' and entering the cup 16' the sprinkler system will be activated. If the ball misses the cup 16', then the ball is retrieved through the retrieving trap 21, not accessible to the player. Alternatively, the switch in the cup 16' may be connected to a light and sound system 22 to generate a visual and/or audible alarm in the vicinity of the amusement system whereby all players utilizing the system are induced to laugh. Obstacles, such as water traps 9 or ramps 9', may be provided on the putting surface.

Figure 2:
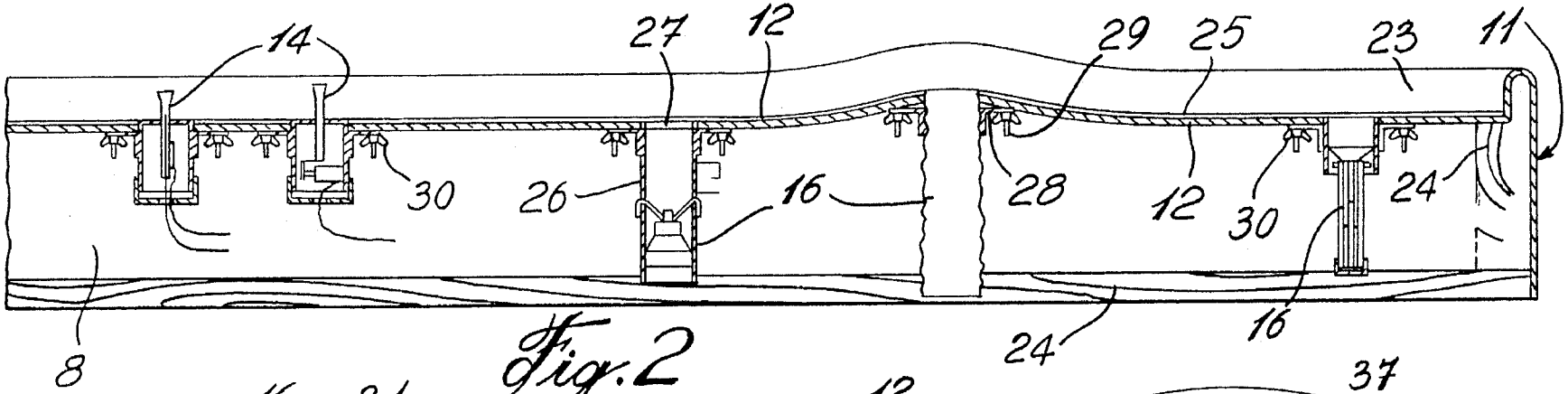
FIG. 2 is a section view of a putting platform illustrating the construction of a variety of tees and golf cups which are connectable to individual ones of the platforms.

Referring now to FIG. 2, there is shown the construction of one of these platforms 11 and various golf support tees and examples of golf ball cups 16 that may be secured under the platforms. As herein shown, the platforms 11 are molded from fiberglass material 23 and reinforcing wood braces 24, and they define a putting deck 12 on which a grass-simulated carpet 25 or paint is applied. The platforms have side walls to maintain the putting deck elevated to permit the cup cylinders 40 to be secured under the deck 12. The golf cups 16 are comprised of a cylinder, usually a plastic tube 26, having an open top end 27. A securement flange 28 is secured about the cylinder and spaced a predetermined distance below the open top end 27 thereof. The flange 28 is provided with holes to receive fasteners 29, usually secured in the fiberglass deck 12. Wing nuts 30 secures the cup thereunder. Accordingly, the cups 16 are easily securable and interchangeable. If desired, there may be provided two or more holes for the cups with the holes not used being provided with plugs (not shown) whereby the position of the cup may be displaced from time to time.

Figure 4:
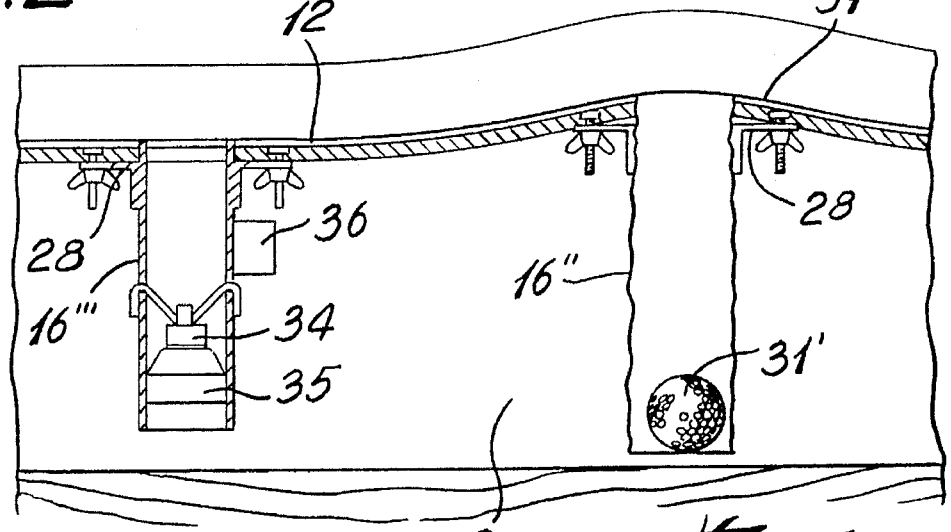
FIG. 4 is a section view showing a putting platform having an undulating putting deck as well as the securement of a deep golf cup and golf cup simulating electric shocks.
Figure 3:
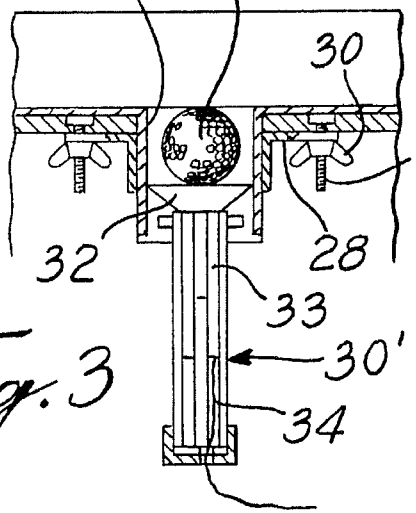
FIG. 3 is a section view showing the construction of a golf cup with a solenoid activated plunger secured therein.

Referring now to FIGS. 3 and 4, there are shown examples of the construction of cups associated with the golf putting amusement system of the present invention. More specifically, as shown in FIG. 3, the cup 16 is provided with a laughter-inducing means comprised of a plunger device 30 which is actuated when a golf ball 31 enters the cup 16 and contacts the head 32 of the plunger moving a cylinder portion 33 and causing a solenoid 34 to be activated to move abruptly upwardly to eject the ball 31 from the cup 16.

With reference to FIG. 4, there is shown another type of laughter-inducing means, herein constituted simply by a deep cup 16", causing a player to reach deeply within the cup to retrieve a golf ball, such as the ball designated by reference numeral 31'. The fact that the player has to reach deep into the cup comes as a surprise and induces laughter.

As also seen in FIG. 4, the cup 16''' may also be provided with a laughter-inducing means constituted by a light 34 secured at the bottom of the cup together with a vibrator device 35 secured to the wall of the cup. A photo-electric sensor 36 is also secured to a side wall of the cup and when the hand is positioned in the cup to retrieve the ball, the vibrator device and light are actuated by the sensor simulating an electric shock, thus inducing laughter to the person playing the game to provide a more challenging feat.

As noted in FIG. 4, the deck 12 may also be provided with undulations 37 to cause the golf balls to rise up to a peak area where the golf cup may be provided to provide a more challenging feat.

Figure 5:
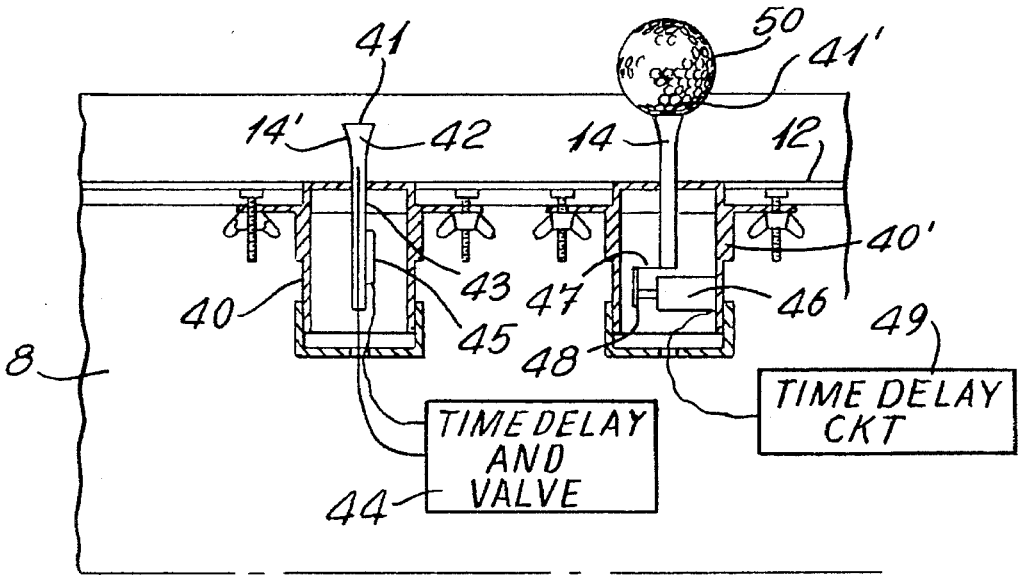
FIG. 5 is a section view, partly in schematic form, showing different tee constructions with laughter-inducing devices secured thereto.

Referring now to FIG. 5, there is shown two different constructions of the support tees 14. As herein shown, support tee 14' is also mounted on a support cylinder 40 which is secured to the underface of the putting deck in a similar fashion as the cups 16. The tee 14' has a golf ball support upper end 41 with a cavity or channel 42 extending within the tee to the upper end. A water jet having a nozzle 43 is located within the cavity 42 to direct water towards the upper end 41. A time delay circuit 44 senses the presence of a golf ball disposed on the support surface 41 by a sensor 45, and actuates the time delay which in turn activates a valve associated therewith. The valve turns on the flow of water to direct a water jet towards the upper end, thereby displacing the ball off the tee after the said predetermined time delay, and direct a water jet upwardly to skirt the player and induce laughter.

In another embodiment of the golf ball support tee, as illustrated at 14", the tee is also mounted in a support cylinder 40' which is removably secured to the underface of the putting deck 12. the tee 14" has a golf ball support upper end 41'. A vibrating device 46 is secured to the tee 14" via the linkage 47. A sensor 48 detects the presence of the ball on the tee by the displacement of the tee on the linkage 47 and actuates the time delay circuit 49 associated with the vibrating device 46 to cause the tee to vibrate after a predetermined time delay and whereby a golf ball 50 positioned on the tee 14" will fall off the tee if it has not been already struck by the user.

Figure 6A:
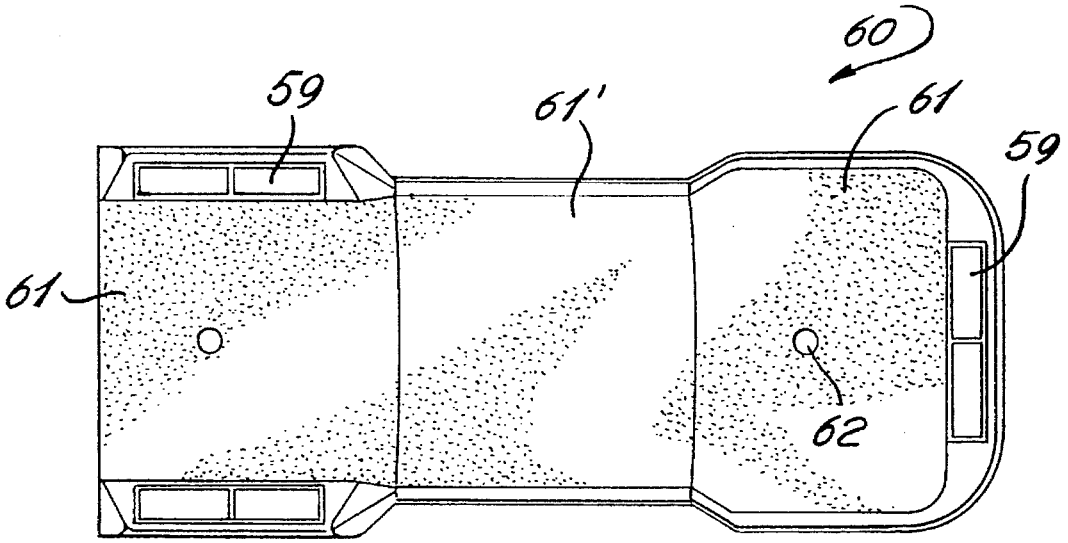
FIGS. 6A and 6B are top and side views respectively of a sectioned putting platform constructed in accordance with the present invention and wherein the platform is formed from modular sections that are interconnected together.
Figure 6B:
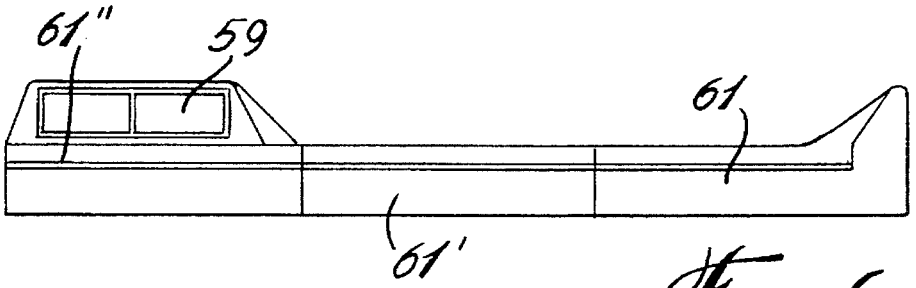

Referring now to FIGS. 6A and 6B there is shown the construction of a golf putting platform 60 which consists of different modules 61, 61' and 61" interconnected together to form a putting surface having a desired characteristic. Some of these sections may have putting surfaces on angulated sections, undulated sections or curved and sloped sections. Accordingly, a non-limited number of putting platform designs are conceivable when selected sections are interconnected. All of the platforms utilize a starting tee platform section 61 equipped with a tee, of the type, for example, as described in FIGS. 8A to 8C or previously described with reference to FIG. 5. There may be provided more than one straight section 61' or angulated sections with flat or undulated top surfaces. These sections 61, 61' and 61" are secured together by anchor nuts and bolts (not shown), of a type well known in the art. Over the top surfaces of these platforms a putting carpet is then installed and when a section is removed to modify the layout of the putting surface, it is only necessary to remove the carpet and add new sections.

The cup and the tee sections may have window areas 59 in the top surface therefor for providing advertising or displaying rules or jokes as seeing that this is a laughter-inducing game. These window areas 59 can also be back lit from underneath the platforms which have a hollow area 63 as shown in cross-section in FIG. 7. These platform sections are made of molded fiberglass and may be of different colors by mixing a color pigment within the fiberglass whereby the coloring will resist scratches, sun fading, rain and other inclement elements. These platforms are provided with holes to install the putting tees and the cup devices. These cup and tee devices are easily secured by two mounting bolts which are permanently secured underneath the platform, as previously described. These bolts, as shown in FIG. 4, act to hold the cup and tee devices in place and these are easily interchangeable.

Figure 7:
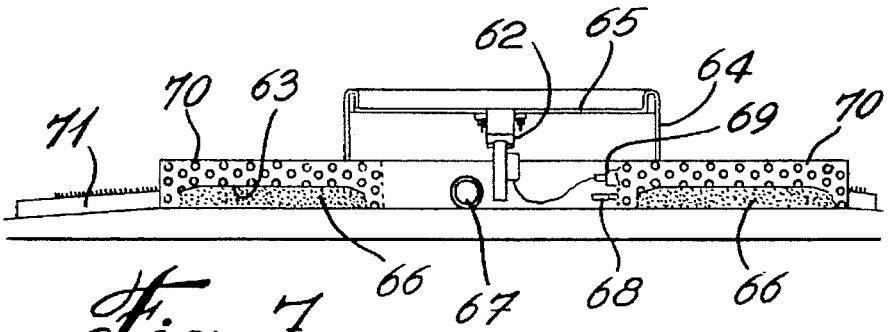
FIG. 7 is a cross-section view showing a platform installed on a prepared ground surface.

As shown in FIG. 7, the cup sections 64 is an elevated section having a slope upper wall 65 with a cup 66 secured therein. The platforms are mounted on a cement base 70 poured over a gravel bed 66 and a french drain 67 is disposed under the platform to evacuate water. A water faucet 68 may also be secured to the platform thereunder as well as a 12 or 24 DC connector 69. Top soil and grass 71 may then be applied to the sides of the platform for finishing.

Figure 8A:
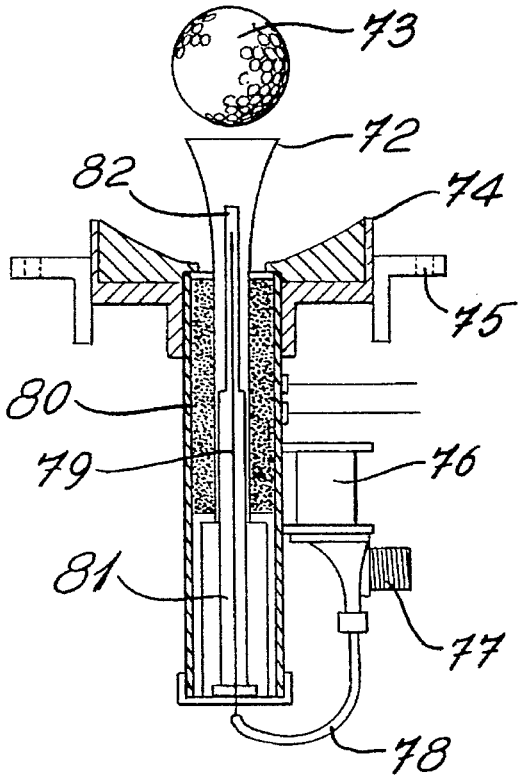
FIGS. 8A. 8B, and 8C are fragmented section views showing the construction of putting tees having different laughter-inducing structural features
Figure 8B:
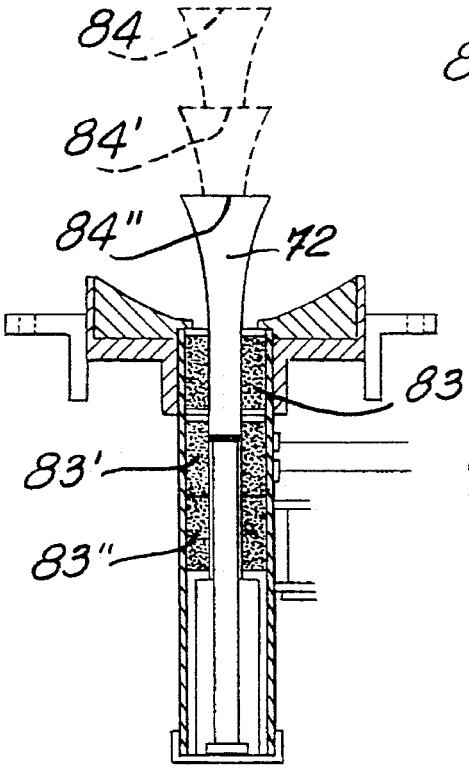
Figure 8C:
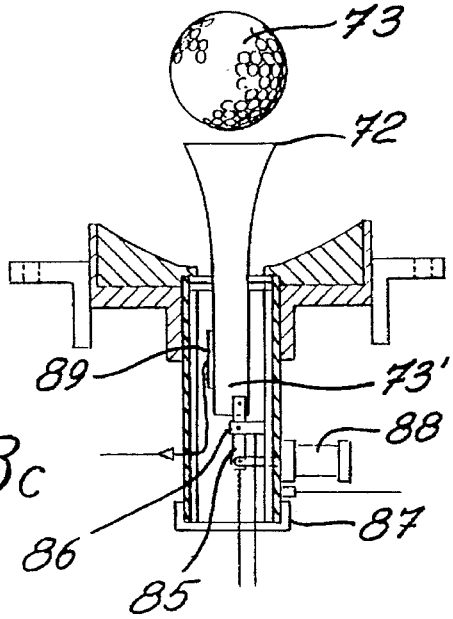

Referring now to FIGS. 8A to 8C, there is illustrated various tee structures connectable to the hole 62 provided in the putting section 61 of the platform 60. The tee design as shown in FIG. 8A comprises a spring tee 72 on which a golf ball 73 is positioned. The cup 74 is provided with the attachment ring 75 to secure same under the platform. A solenoid valve 76 actuates a hose connector 77 to which a water hose is connected whereby to release water under pressure in a flexible tube 78 leading to a spray head 79 through which water is ejected in a jet. A solenoid 80 is secured about the tube 79 and is actuable electronically by a control circuit whereby to move the plunger 81 upwardly to eject the ball 73 from the tee 72. When the golfer sets the golf ball 73 on the tee, a sensor switch informs a control processing unit that the tee is being used. When the processing unit is activated by the sensor, a timing cycle starts and after a predetermined time delay, the solenoid 80 is actuated. The plunger 81 is pulled up and pushes the ball off the tee. Immediately thereafter, a second timing cycle is actuated and this could take, for example, four seconds and then, the second solenoid 76 is actuated to open the valve in the hose connector whereby a spray of water will come out of the tee 72. At that instant, the user or person is in the immediate vicinity of the tee and will be sprayed by the water jet which extends into the push tube 82 which pushes the ball off the tee. After the ball is pushed off the tee, the cycle is repeated.

FIG. 8B utilizes a tee wherein three solenoids 83, 83' and 83" may be actuable in sequence whereby to elevate the tee quickly and smoothly. When the tee 72 is extended to its outermost position as shown at 84, a timing cycle is reversed and the tee starts moving inwards in the same quick and smooth manner to its secondary position 84' and its normal position 84". This displacement will cause the player to strike the ball differently than he intended.

Referring now to FIG. 8C, there is shown another manner in which the tee may be constructed in order to create laughter. As herein shown, the tee 72 has a pivot shaft 85 secured to a lower end 73' thereof. The pivot shaft is secured to a hinge connection 86 and the lower end thereof is secured to the plunger 87 of a solenoid 88. Once the golfer places the ball on the golf tee 72, a sensor 89 sends a signal to a processing unit to start a timing cycle. At the end of this timing cycle, the processor unit conducts electricity to the solenoid 88 to activate it. When the solenoid is activated it will move the golf tee to one side which in turn will make the golf ball fall off the tee. This timing cycle is repeated every time a golf ball is placed on the golf tee.

Figure 9A:
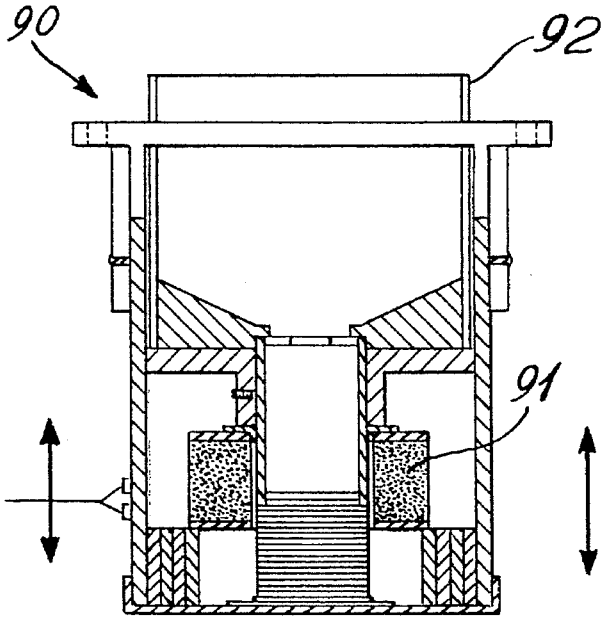
FIGS. 9A and 9B are fragmented section views showing a golf cup also having a laughter-inducing structural feature.
Figure 9B:
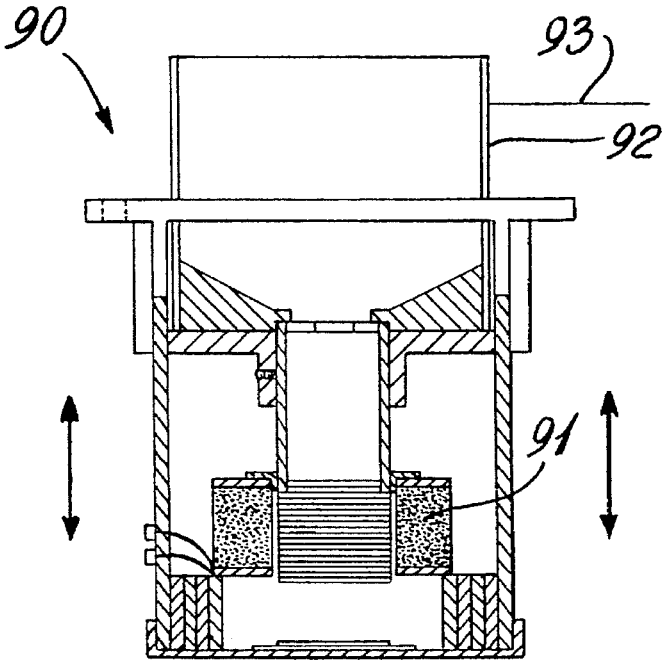

Referring now to FIGS. 9A and 9B, there will be described another example of the construction of a golf cup 90 which is displaceable to prevent a ball from entering the cup once a golfer is near the cup. When the golfer approaches the cup, a sensor is located under the playing surface of the platform, such as platform 61", and is activated by the weight of the golfer. This will send a signal to the processing unit which will actuate the solenoid 91 causing the cup 92 to project upwardly, as shown in FIG. 9B, out of the putting surface 93 of the putting platform section 61". This will prevent the golf ball from entering the cup. The solenoid is activated for a cycle of approximately 2 seconds, therefor causing the upper section of the cup 92 to rise and lower every two seconds for up to ten or more times whereby the player may attempt to put the ball into the cup 92 when is it lowered. However, the cycle time will prevent the ball from entering the cup in most putting attempts, thereby inducing laughter.

Many other laughter-inducing means may be conceived for the golf putting amusement system of the present invention and it is within the ambit of this invention to cover any obvious modifications of the preferred embodiments described herein, provided such modifications fall within the scope of the appended claims.

I claim:

1. A miniature golf putting amusement system comprising a plurality of putting platforms each having an elevated putting deck with a golf ball teeing area at one end and having a golf ball support tee extending above a top surface of said deck, a golf cup area at an opposed end of said deck, grass simulation means on at least a portion of said top surface of said putting deck, a golf cup having an open top end removably secured under said putting area at said golf cup area with said top end being opened in said top surface, said golf cup having a means for being interchangeable from under said elevated putting deck with different golf cups having different internal mechanisms, said cup having an internal mechanism having an activatable element which is actuated when a golf ball enters or is retrieved from said cup and performing a function whose object is to induce laughter to a player person; said platforms being prefabricated platforms disposed in a specific orientation with respect to one another.

2. A golf putting amusement system as claimed in claim 1 wherein there is further provided external activatable means located externally of said plurality of putting platforms and actuable by a golf ball entering said cup of a particular one of said plurality of putting platforms.

3. A golf putting amusement system as claimed in claim 2 wherein said external activatable means is a water valve connected to a water pressurized conduit and one or more sprinklers.

4. A golf putting amusement system as claimed in claim 2 wherein said external activatable means is a sound and/or light system activatable by said internal mechanism.

5. A golf putting amusement system as claimed in claim 2 wherein said internal mechanism is a switch located in a bottom of said cup and actuable by the weight of a golf ball resting thereon.

6. A golf putting amusement system as claimed in claim 1 wherein said golf cup is comprised of a cylinder having said open top end, a flange about said cylinder spaced a predetermined distance below said open top end, said flange having holes to receive fasteners to secure same to an underface of said putting deck.

7. A golf putting amusement system as claimed in claim 1 wherein said platforms are fiberglass platforms molded with wood reinforcing braces, said platforms having depending side walls to maintain said putting deck elevated to permit said golf cup to be secured thereunder.

8. A golf putting amusement system as claimed in claim 1 wherein said golf cup is an elongated cylinder causing a player to reach deeply within the cup to retrieve a golf ball.

9. A golf putting amusement system as claimed in claim 1 wherein said golf cup has a light secured therein, a vibrator device also secured to said cup, said light and vibrator device being actuated by a photo-electric sensor further mounted on said cup and actuable when a hand is placed in said cup to remove said ball, said light and vibrator simulating an electric shock.

10. A golf putting amusement system as claimed in claim 1 wherein said golf cup has a plunger device secured therein, said plunger device having a solenoid and being actuated when a golf ball enters said cup and contacts said plunger causing said solenoid to operate and eject said ball from said cup.

11. A golf putting amusement system as claimed in claim 1 wherein said golf ball support tee is mounted in a support cylinder removably secured to an underface of said putting deck, said tee having a golf ball support upper end, a cavity in said tee, a water jet in said cavity having a nozzle directed to said upper end, time delay means actuable by sensing the presence of a golfer besides said tee and activating said water jet after a predetermined time delay to direct a water jet toward said upper end.

12. A golf putting amusement system as claimed in claim 1 wherein said golf ball support tee is mounted in a support cylinder removably secured to an underface of said putting deck, said tee having a golf ball support upper end, an electric solenoid secured to said tee, sensor means connected to said tee to detect a golfer located beside said tee, said sensor means actuating a time delay circuit associated with said electric solenoid to cause said solenoid to lift the ball off said tee at a predetermined time intervals whereby a golf ball placed on said upper end will repeatedly fall off said tee.

13. A golf putting amusement system as claimed in claim 1 wherein said putting platforms are formed from modular sections interconnected together, one of said sections being a putting section having said putting deck with said golf ball support tee, another of said sections being a golf cup section having said golf cup secured therein, and one or more intermediate sections interconnected between said putting and golf cup sections.

14. A golf putting amusement system as claimed in claim 13 wherein said intermediate and golf cup sections have at least undulated or sloped portions in a putting upper surface thereof or may be angulated platform sections.

15. A golf putting amusement system as claimed in claim 1 wherein said golf cup is provided with a means for raising and lowering said golf cup above said top surface of said putting deck at predetermined time intervals to displace said cup to move in and out of said putting surface.

16. A golf putting amusement system as claimed in claim 1 wherein said ball support tee has a plunger actuable means for raising and lowering said tee in predetermined increments and at predetermined time intervals.

* * * * *